US010857654B2

(12) United States Patent
Snider et al.

(10) Patent No.: US 10,857,654 B2
(45) Date of Patent: Dec. 8, 2020

(54) RELEASE LEVER FOR MAGNETIC TOOL WITH ALIGNMENT INSERT ELEMENT

(71) Applicant: Atlantic Exchange Inc., Wallburg, NC (US)

(72) Inventors: Steven Jay Snider, Grafton, OH (US); Lowell Lamar Snider, Wallburg, NC (US); Hendrik H. Drenth, Wallburg, NC (US); Jaap J. Drenth, Wallburg, NC (US)

(73) Assignee: Atlantic Exchange Inc., Wallburg, NC (US)

( * ) Notice: Subject to any disclaimer, the term of this patent is extended or adjusted under 35 U.S.C. 154(b) by 0 days.

(21) Appl. No.: 15/825,375

(22) Filed: Feb. 8, 2018

(65) Prior Publication Data

US 2018/0147697 A1 May 31, 2018

Related U.S. Application Data

(60) Provisional application No. 62/428,483, filed on Nov. 30, 2016.

(51) Int. Cl.

| | |
|---|---|
| ***B25B 9/00*** | (2006.01) |
| ***H01F 7/02*** | (2006.01) |
| ***B25B 11/00*** | (2006.01) |

(52) U.S. Cl.

CPC ..... *B25B 9/00* (2013.01); *B25B 11/002* (2013.01); *H01F 7/0257* (2013.01)

(58) Field of Classification Search

CPC ... B03C 1/30; B66C 1/02; H01F 7/206; H01F 7/0252; H01F 7/0257; B25J 1/04; B25B 9/00; B25B 11/002

See application file for complete search history.

(56) References Cited

U.S. PATENT DOCUMENTS

| | | | | |
|---|---|---|---|---|
| 3,384,408 A * | 5/1968 | Furzey | ..... | B25B 9/00 294/65.5 |
| 4,105,239 A * | 8/1978 | Akczinski, Sr. | ..... | A47L 13/41 294/210 |
| 4,802,702 A * | 2/1989 | Bownds | ..... | A47L 13/41 294/210 |

(Continued)

*Primary Examiner* — Stephen A Vu

(74) *Attorney, Agent, or Firm* — NK Patent Law

(57) ABSTRACT

A magnetic hand tool and method of assembly for manipulated conveyance over a surface for magnetic collection of ferrous articles, by which procedure a quick-release cap is used to release any and all collected ferrous material. This tool utilizes an alignment insert in a central opening of the magnet to coaxially align fastener guide holes through polar plates or protective covers on opposing planar sides of the magnet and a fastener guide hole in the insert, whereby insertion of the fastener through the guide holes laterally aligns the components of the assembly.

The invention is the release device/cap, that is part of the assembly by means of a self-adhering or hinged cap with a lip, square, circular or other shape, to aid in the separation of ferrous material from the magnetic tool by pushing away the cap from the magnetic hand tool by holding the lip for that purpose. The divots make it that the release lever device/cap is held onto the magnetic hand tool assembly. The separation allows for the ferrous material to fall in the drop collection box by ways of gravitational pull.

8 Claims, 4 Drawing Sheets

(56) References Cited

U.S. PATENT DOCUMENTS

| | | | | |
|---|---|---|---|---|
| 6,158,792 | A * | 12/2000 | Snider | A47L 13/41 209/215 |
| 6,669,024 | B2 * | 12/2003 | Ottens | A47L 13/41 209/215 |
| 7,124,617 | B2 * | 10/2006 | Satterlee | B21D 1/06 72/430 |
| 9,016,739 | B2 * | 4/2015 | Mondano | A47F 13/06 294/190 |

* cited by examiner

RELEASE LEVER FOR MAGNETIC TOOL WITH ALIGNMENT INSERT ELEMENT

FIELD OF THE INVENTION

The present invention pertains generally to tool assemblies and, more particularly, to the construction and assembly of magnetic tools with a releasing device to separate collected ferrous material from the magnetic tool.

BACKGROUND OF THE INVENTION

Magnetic tools, such as hand tools, ferrous object pickup tools and magnetic sweepers, are widely used for commercial and consumer applications. One popular form of a magnetic hand tool has a magnetic head, which is generally disk shaped, made with speaker magnets in the form of, generally, circular rings. Ferrous steel plates are placed on opposite sides of the disk. The magnetic flux is concentrated in the two plates. The central hole in the, generally, but not limited to, ring-shaped magnet is relatively large, e.g. approximately one third the size of the outer dimensions of the magnet. The magnet is held between upper and lower steel plates, by which the magnet is polarized across the width of the ring between the opposite planar sides. The plates are configured to match the outer dimensions of the magnet, so that the magnet is completely sandwiched between the plates. Assembling the tool requires that the edges of the upper and lower plates be nearly perfectly aligned with the outer perimeter of the magnet and permanently held in this position. A rivet or other fastener is passed through the plates and through a hole in the magnet to keep the assembly tightly stacked together. Because the hole in the magnet is larger than the diameter of the fastener, an alignment insert with guide hole is positioned inside the hole in the magnet to coaxially align the fastener with the upper plate guide hole and the lower plate guide hole.

As the magnetic hand tool was invented and created, it was missing the benefit of a release lever device so that the operator would not be hurt in the removal of the picked up ferrous materials. As such, a release device is part of the assembly by means of a self-adhering or hinged cap with a lip, square or any other shape, to aid in the separation of ferrous material from the magnetic tool by pushing away the cap from the magnetic hand tool using the lip for that purpose.

BRIEF SUMMARY OF THE INVENTION

The present invention overcomes the aforementioned disadvantages of removing ferrous material by hand as it facilitates the easy removal of ferrous materials from the magnetic hand tool by means of a release lever device/cap. By providing a magnetic tool with a self-adhering, using pressure stubs, or hinged release lever device/cap, which can be quickly attached, and which is held in alignment without the use of adhesives, the tool becomes very user friendly to and safer for the operator when it comes to the removal of ferrous material. The magnetic tool assembly includes an alignment insert element, which permanently aligns the magnet with upper and lower plates, eliminating the need for adhesive.

In accordance with one general aspect of the invention, there is provided a generally circular magnet tool assembly having upper and lower generally circular plates on respective opposite planar sides of a circular generally disk-shaped magnet, the magnet having a control opening larger than an outer diameter of a fastener, which passes through the upper and lower plates and the magnet, and an alignment insert element positioned in the central opening in the magnet, an outer dimension of the insert dimensioned to occupy substantially all of the central opening of the magnet, and a through-hole in the insert dimensioned to allow passage of the fastener through the insert after which the release lever device/cap is manually positioned on the bottom of the magnetic assembly by pressure or the use of hinges. The method of assembly includes the steps of:

1. Providing a generally, but not limited to, circular disk-shaped magnet having an opening, which passes through the magnet from an upper planar surface to a parallel lower planar surface;
2. Inserting an alignment element in the opening in the magnet so that the perimeter of the alignment element extends to an inner dimension of the opening in the magnet, so that a fastener hole in the alignment element is substantially axially aligned with the opening in the magnet;
3. Positioning an upper plate substantially flush against the upper surface of the magnet and aligning a perimeter of the upper plate with a perimeter of the magnet;
4. Positioning a lower plate substantially flush against the lower surface of the magnet and aligning a perimeter of the lower plate with a perimeter of the magnet, and
5. Inserting a fastener through coaxially aligned holes in the upper and lower plates and the alignment element, whereby the plates and magnet are held in coaxial alignment by the alignment insert;
6. Clipping on the release lever cap/device or hinging it as to enable the operator of the magnetic hand tool to safely release all collected ferrous materials.

These and other aspects of the invention are herein described in detail with reference to the accompanying Figures.

BRIEF DESCRIPTION OF THE INVENTION

Figure 1:
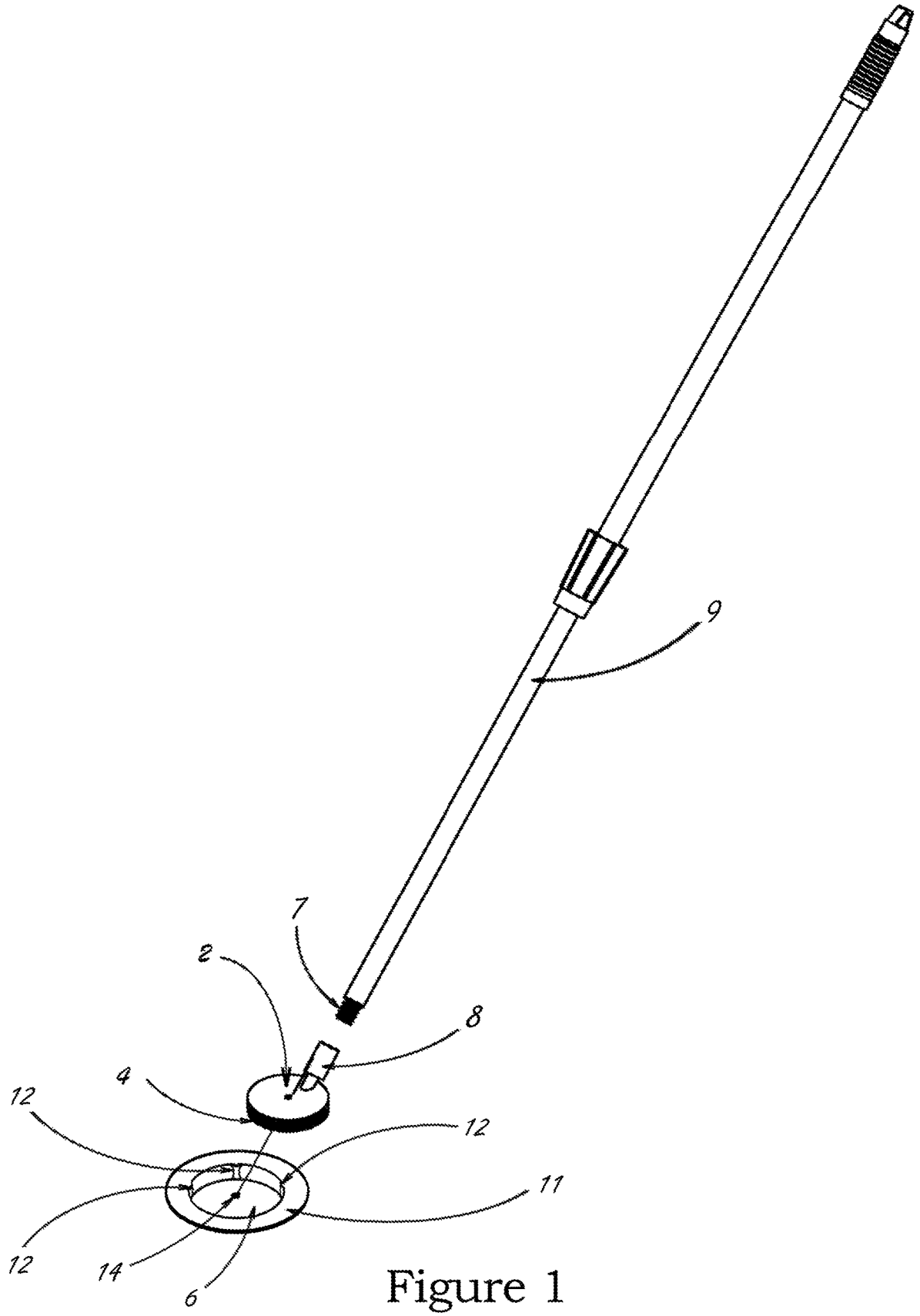
FIG. 1 is a perspective view of one embodiment of a magnet circular hand tool constructed in accordance with the present invention and with an adjustable handle for the manipulated conveyance over a surface.
Figure 2:
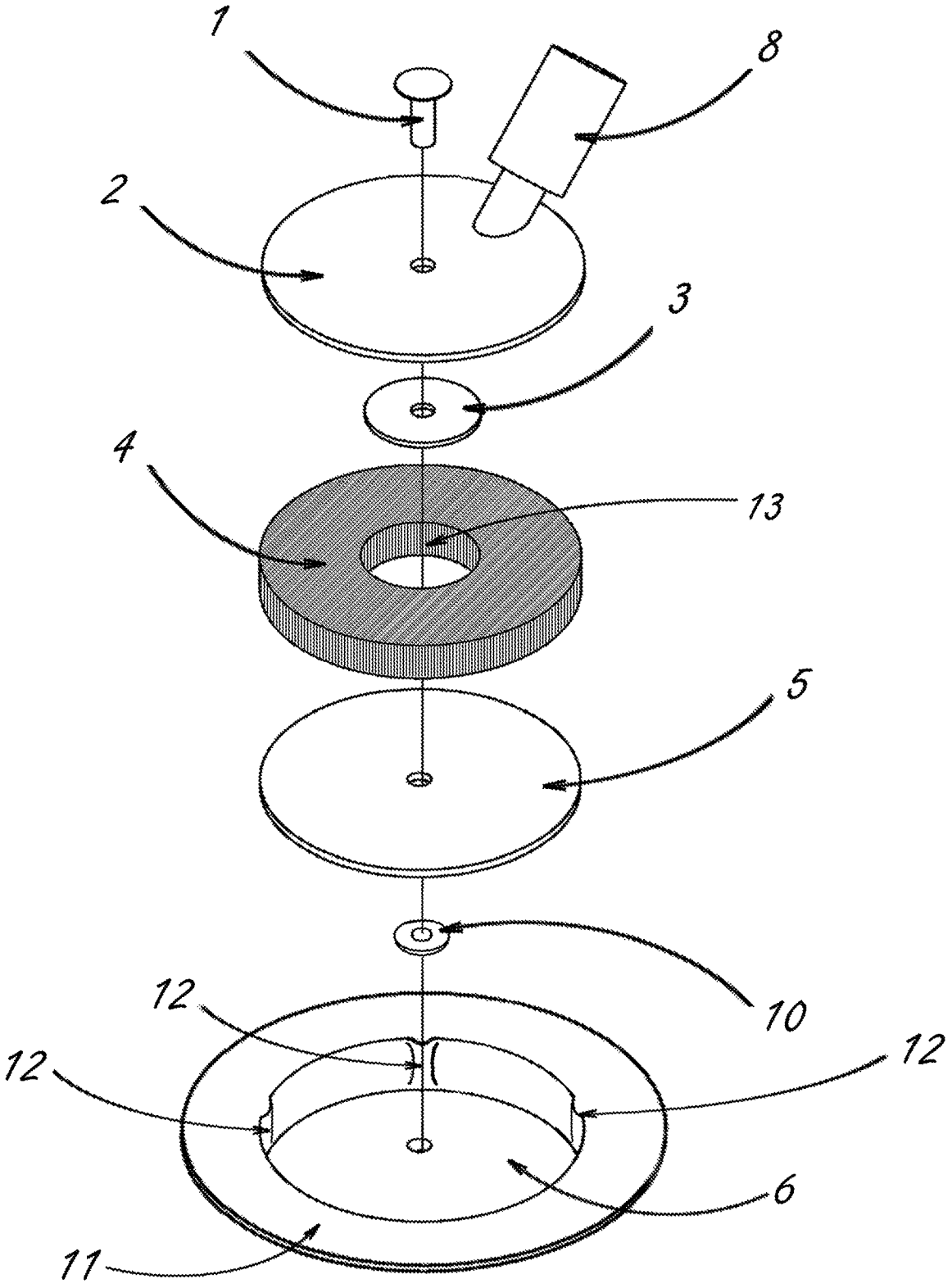
FIG. 2 is an exploded perspective view of the circular magnet tool of FIG. 1 with a circular release lever and a circular tip.

As shown in the Figures, the invention is a magnet tool assembly, generally indicated at FIG. 1, with a release lever/device. This allows for easy removal of the ferrous material without the operator having to be in direct contact with it. By simply pushing the cap downward (pull or using hinges) off the circular magnet assembly by putting downward force to the tips on the side of the cap (circular tip or pointed/square tips or any other shape tip) by hand, by foot or otherwise putting downward force to the tips, a gap is created between the ferrous material and the magnet. As such, the ferrous material pieces are moved out of the magnetic field and fall away by means of normal gravitational pull.

The invention is the release device/cap, that is part of the assembly by means of a self-adhering or hinged cap with a lip, square, circular or other shape, to aid in the separation of ferrous material from the magnetic tool by pushing away the cap from the magnetic hand tool by holding the lip for that purpose. The divots make it that the release lever device/cap is held onto the magnetic hand tool assembly. The separation allows for the ferrous material to fall in the drop collection box by ways of gravitational pull.

DETAILED DESCRIPTION OF THE INVENTION

As shown in the Figures, the invention is a magnetic hand tool assembly FIG. 1, which includes a generally, but not limited to, circular disk-shaped magnet 4 and, specifically, a removable release device/cap to allow the easy removal of collected ferrous materials. In this embodiment, as also described in U.S. Pat. No. 6,124,777, dated Sep. 26, 2000, the magnet 4 is ring-shaped, with an annular perimeter at the outer diameter or dimension of the magnet, and an opening or through-hole 13, with a perimeter located at the inner diameter or dimension. The magnet 4 has an upper planar surface 2, and a parallel lower planar surface 5. Although referred to as "upper" and "lower", the description and invention are not limited to any particular orientation of these surfaces or components.

An alignment insert 3 has a shape dimensioned to fit within the opening 13 of the magnet 4, with the insert oriented in a plane parallel with an outer diameter or dimension, which fits closely within the opening 13. The insert 3 is made of a non-ferrous material, which does not interact with the poles flux of the magnet 4. The insert further includes a fastener guide hole 14, which is generally coaxially aligned with the opening 13 in the magnet 4.

An upper plate 2 has a perimeter, which is dimensioned preferably closely similar to the perimeter of the magnet 4, and a centrally disposed fastener guide hole 14, which is generally coaxially aligned with the guide hole 14 of the alignment insert 3 when the perimeter of the upper plate 2 is generally aligned with the perimeter of the magnet 4.

Figure 3:
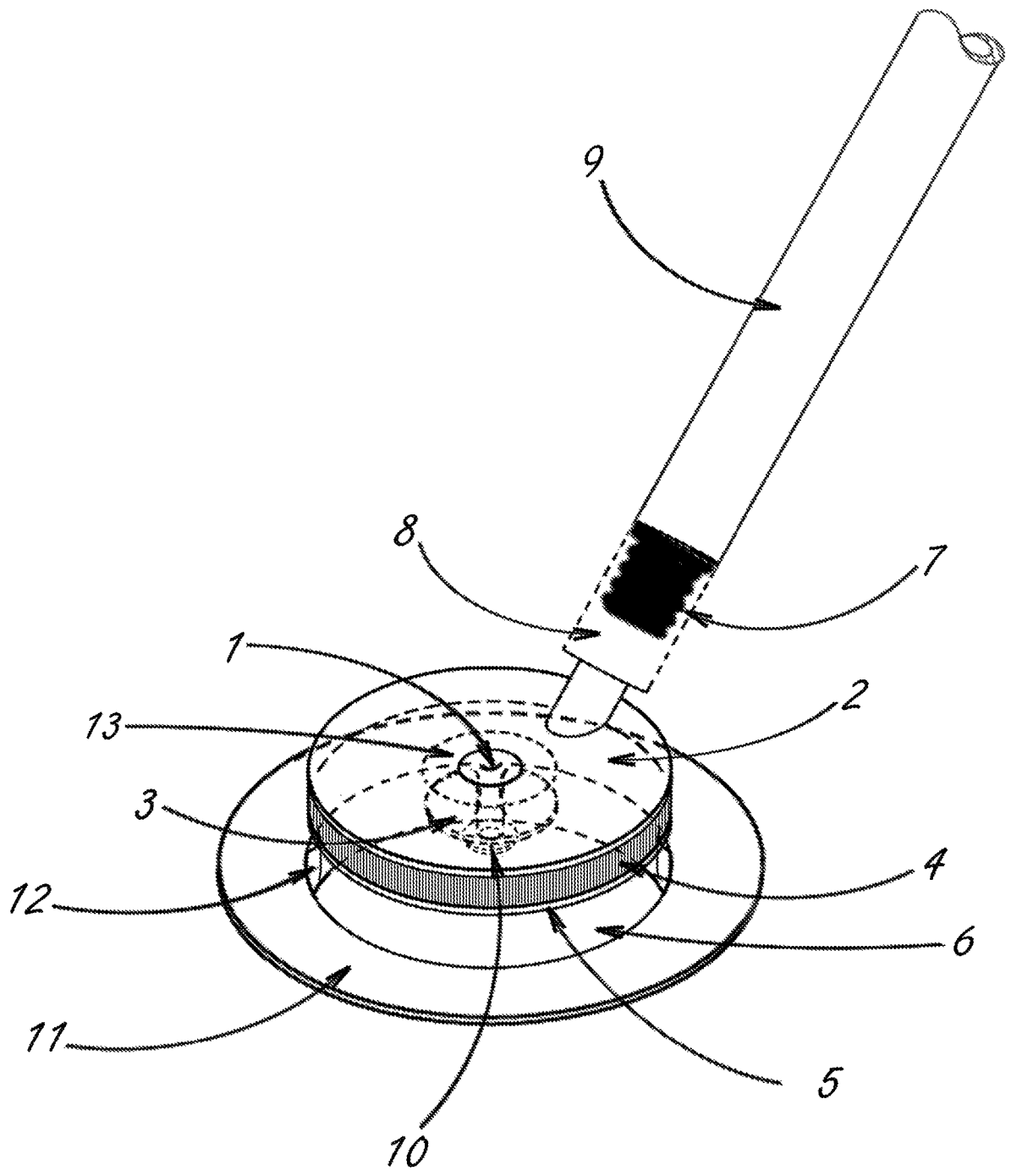
FIG. 3 is a perspective view of an enlarged, detailed embodiment of a magnetic circular hand tool constructed in accordance with the present invention as it includes the release lever device/cap.
Figure 4:
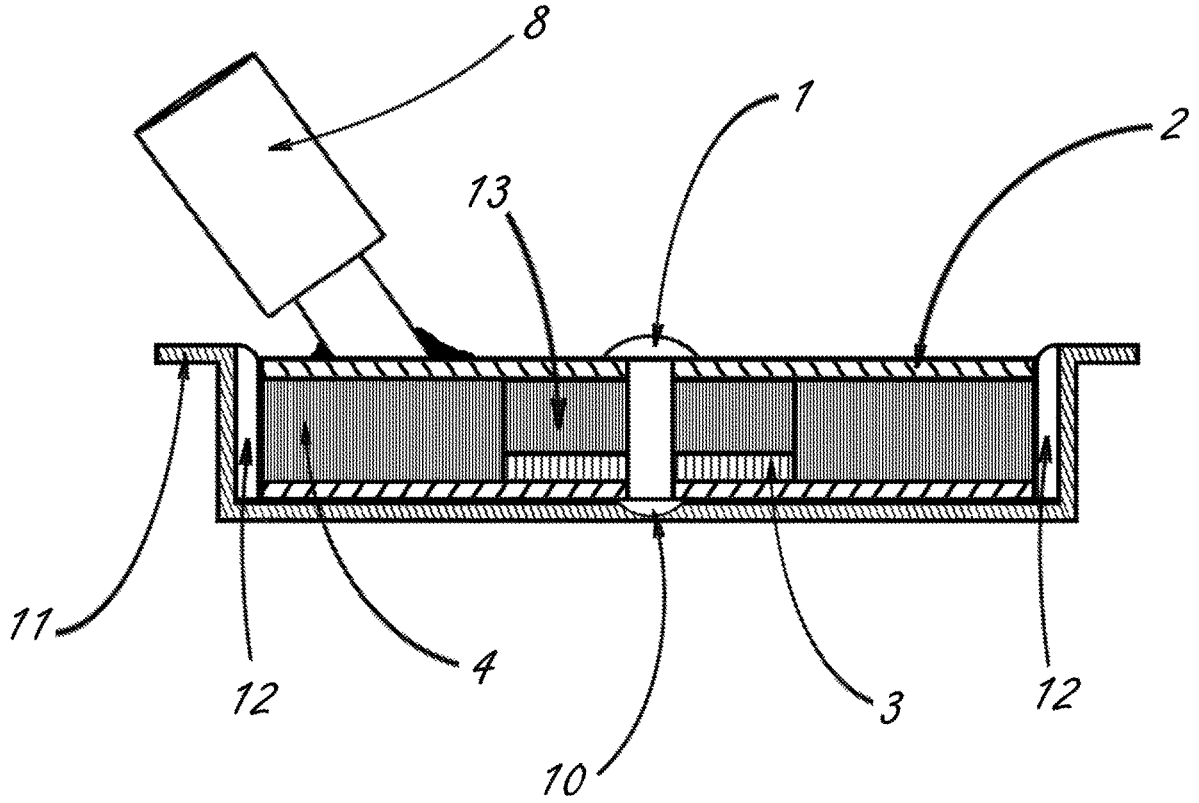
FIG. 4 is a cross-cut view of the magnetic circular hand tool constructed in accordance with the present invention as it includes the release lever device/cap.

A lower plate 5 is configured similarly to the upper plate 2, and positioned flush against the lower surface of the magnet 4, with the perimeter and fastener guide hole 14 similarly aligned. The fastener 1, such as a rivet or other suitable device, is passed through the respective guide holes 14 of the parts and through the opening of the magnet 4, whereby the assembly of the upper 2 and lower 5 plates and the magnet 4 are held tightly together and in vertical alignment. As further shown FIG. 1 and FIG. 3, an adjustable-in-length handle 9 may be attached using the male ACME collar 7 and the ACME female receptor 8 for manipulation of the magnetic hand tool assembly.

In a related method of assembly of the magnetic hand tool, the alignment insert 3 is placed within the opening 13 of the magnet 4 prior to positioning of the plates 2 and 5 on the opposing planar surfaces of the magnet. Because the outer diameter of the magnet is substantially equal to the inner dimension or diameter of the opening, the insert 3 is generally oriented parallel with the upper and lower surfaces of the magnet, with the fastener guide hole 14 of the insert 3 generally coaxially aligned with the center axis of the opening 13. Therefore, when the perimeters of the upper and lower plates 2 and 5 are aligned with the perimeter of the magnet, the guide holes 14 are aligned with the guide hole of the insert 3, and the fastener 1 can be easily inserted through the assembly. The assembly process is very quick and does not require the use of any adhesive or preparation of parts prior to assembly.

Once the entire magnet assembly is complete, the circular or square cap with divots is positioned by clipping it onto and over the lower planar surface 5 and the lower circular portion of the magnet 4. Once the cap 6 is positioned the entire assembly is ready for the operator to utilize. Although the invention has been described with reference to a particular embodiment, it will be appreciated that the invention is not limited to magnetic hand tool assemblies of this exact shape and configuration, and that in fact the invention pertains to any type of magnetic hand tool assembly with a release device/cap, that is part of the assembly by means of a self-adhering or hinged cap with a lip, square, circular or any other shape, to aid in the separation of ferrous material from the magnetic tool by pushing away the cap from the magnetic hand tool by holding the lip for that purpose. The separation allows for the ferrous material to fall in the drop collection box by ways of gravitational pull.

LEGEND

Number 1: Top part of one piece rivet
Number 2: Upper planar disk shaped surface
Number 3: Alignment washer/insert
Number 4: Circular disk-shaped magnet
Number 5: Lower planar disk-shaped surface
Number 6: Release lever device/cap
Number 7: Male ACME collar
Number 8: Female ACME connector
Number 9: Adjustable handle for manipulated conveyance
Number 10: Bottom part of one piece rivet
Number 11: Lip on release lever device/cap
Number 12: Divot on inside of release lever device/cap
Number 13: Through-hole inside the magnet
Number 14: Fastener/rivet guide hole coaxially aligned with center axis of opening

The invention claimed is:

1. A magnetic sweeping tool comprising:
an elongated handle;
a magnet engaged at an end of the elongated handle,
a cover that extends over a surface of the magnet that is opposed to the elongated handle, the cover having an annular portion that extends over a circumferential surface of the magnet, and a rim that extends outwardly of the annular portion of the cover, wherein the rim extends radially from a top portion of the cover and provides a surface for pressing the cover off of the magnet,
wherein the tool defines a first orientation in which the cover is in engagement with the magnet, and a second orientation in which the cover is spaced-apart and disengaged with the magnet to reduce the magnetic forces applied to the cover such that ferrous materials magnetically engaged with the cover are then released.

2. The tool of claim 1, wherein the magnet is puck shaped, and the cover defines a depression that receives the magnet.

3. The tool of claim 2, wherein the cover is non-ferrous.

4. The tool of claim 2, wherein the magnet defines a top plate on a top surface thereof, and a bottom plate on a bottom surface thereof.

5. The tool of claim 4, wherein a fastener extends through the top plate, magnet, and bottom plate to secure each thereto.

6. The tool of claim 1, wherein the cover defines a divot on an inner facing surface thereof to provide clearance to aid in removal on the cover from the magnet.

7. A magnetic sweeping tool comprising:

an elongated handle;

a magnet engaged at an end of the elongated handle, a non-ferrous cover that extends over a surface of the magnet opposed to the elongated handle, the cover having an annular portion that extends over a circumferential surface of the magnet, and a rim that extends outwardly of the annular portion of the cover, wherein the rim extends radially from a top portion of the cover and provides a surface for pressing the cover off of the magnet, wherein the tool defines a first orientation in which the cover is in engagement with the magnet, and a second orientation in which the cover is spaced-apart and disengaged with the magnet to reduce the magnetic forces applied to the cover such that ferrous materials magnetically engaged with the cover are then released, wherein the magnet is puck shaped, and the cover defines a depression that receives the magnet, wherein the cover defines a divot on an inner facing surface thereof to provide clearance to aid in removal of the cover from the magnet.

8. A magnetic sweeping tool comprising:

an elongated handle;

a magnet engaged at an end of the elongated handle, a non-ferrous cover that extends over a surface of the magnet opposed to the elongated handle, the cover defining a depression into which the magnet is nested, and the cover further having an annular portion that extends over a circumferential surface of the magnet, and a rim that extends outwardly of a top surface of the cover formed at the depression, the rim extending radially outwardly of the magnet from a top portion of the cover when the cover is engaged with the magnet, the rim providing a surface for pressing the cover off of the magnet, wherein the tool defines a first orientation in which the cover is in engagement with the magnet, and a second orientation in which the cover is spaced-apart and disengaged with the magnet to reduce the magnetic forces applied to the cover such that ferrous materials magnetically engaged with the cover are then released, wherein the magnet is puck shaped, and the cover defines a depression that receives the magnet.

* * * * *